US009447691B2

(12) United States Patent
Smith et al.

(10) Patent No.: US 9,447,691 B2
(45) Date of Patent: Sep. 20, 2016

(54) BUCKET ASSEMBLY TREATING APPARATUS AND METHOD FOR TREATING BUCKET ASSEMBLY

(75) Inventors: Aaron Ezekiel Smith, Simpsonville, SC (US); Gary Michael Itzel, Simpsonville, SC (US); Scott Edmond Ellis, Easley, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 727 days.

(21) Appl. No.: 13/214,583

(22) Filed: Aug. 22, 2011

(65) Prior Publication Data

US 2013/0052009 A1 Feb. 28, 2013

(51) Int. Cl.
*F01D 5/18* (2006.01)

(52) U.S. Cl.
CPC ..... *F01D 5/187* (2013.01); *F01D 5/186* (2013.01); *F05D 2240/81* (2013.01)

(58) Field of Classification Search
CPC .... F01D 5/186; F01D 5/187; F05D 2240/30; F05D 2260/20; F05D 2260/201; F05D 2260/202
USPC ..... 415/115, 116, 1, 90 R, 95, 97 R
See application file for complete search history.

(56) References Cited

U.S. PATENT DOCUMENTS 3,066,910 A * 12/1962 Bluck ..... 416/92
3,950,113 A * 4/1976 Albrecht ..... 416/97 A
4,244,676 A * 1/1981 Grondahl et al. ..... 416/92
4,312,625 A * 1/1982 Pinaire ..... 416/96 R
4,350,473 A * 9/1982 Dakin ..... 416/1
5,382,135 A * 1/1995 Green ..... 416/97 R
5,536,143 A * 7/1996 Jacala et al. ..... 416/96 R
5,848,876 A * 12/1998 Tomita ..... 416/96 R
5,915,923 A * 6/1999 Tomita ..... F01D 5/187 415/115
6,019,579 A * 2/2000 Fukuno et al. ..... 416/97 R
6,071,075 A * 6/2000 Tomita et al. ..... 416/97 R
6,079,946 A * 6/2000 Suenaga et al. ..... 416/97 R
6,092,983 A * 7/2000 Tomita et al. ..... 415/115
6,132,173 A * 10/2000 Tomita et al. ..... 416/96 R
6,390,774 B1 * 5/2002 Lewis et al. ..... 416/96 R (Continued)

FOREIGN PATENT DOCUMENTS

JP 2004003506 A 1/2004

OTHER PUBLICATIONS

Translation of CN Office Action issued on Feb. 9, 2015 in relation to corresponding CN application 201210299794.7.

*Primary Examiner* — Sean J Younger
(74) *Attorney, Agent, or Firm* — Dority & Manning, P.A.

(57) ABSTRACT

A bucket assembly and a method for treating a bucket assembly are disclosed. The bucket assembly includes a platform, the platform defining a platform cooling circuit, and an airfoil extending generally radially outward from the platform, the airfoil defining an airfoil cooling circuit. The bucket assembly additionally includes a lower body portion extending generally radially inward from the platform, the lower body portion defining a root and a cooling passage extending from the root, the cooling passage in fluid communication with the airfoil cooling circuit. The bucket assembly further includes a transfer passage defined between and in fluid communication with the airfoil cooling circuit and the platform cooling circuit such that a cooling medium may flow from the airfoil cooling circuit through the transfer passage to the platform cooling circuit.

20 Claims, 4 Drawing Sheets

(56) References Cited

U.S. PATENT DOCUMENTS

| | | | | |
|---|---|---|---|---|
| 6,402,471 | B1 * | 6/2002 | Demers et al. | 416/97 R |
| 6,481,972 | B2 * | 11/2002 | Wang et al. | 416/233 |
| 7,147,439 | B2 | 12/2006 | Jacala et al. | |
| 7,255,536 | B2 * | 8/2007 | Cunha et al. | 416/97 R |
| 7,309,212 | B2 * | 12/2007 | Itzel et al. | 416/193 A |
| 7,416,391 | B2 | 8/2008 | Veltre et al. | |
| 7,513,738 | B2 | 4/2009 | Itzel et al. | |
| 7,553,131 | B2 * | 6/2009 | Cunha et al. | 416/92 |
| 7,819,629 | B2 * | 10/2010 | Liang | 416/97 R |
| 7,845,907 | B2 * | 12/2010 | Pietraszkiewicz | F01D 5/186 416/97 R |
| 2007/0116574 | A1 * | 5/2007 | Itzel et al. | 416/193 A |
| 2009/0202339 | A1 | 8/2009 | Torii et al. | |
| 2010/0239432 | A1 * | 9/2010 | Liang | 416/97 R |

* cited by examiner

BUCKET ASSEMBLY TREATING APPARATUS AND METHOD FOR TREATING BUCKET ASSEMBLY

FIELD OF THE INVENTION

The subject matter disclosed herein relates generally to turbine system bucket assemblies, and more specifically to treating apparatus for bucket assemblies and methods for treating bucket assemblies.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

Various strategies are known in the art for cooling various gas turbine system components. For example, a cooling medium may be routed from the compressor and provided to various components. In the compressor and turbine sections of the system, the cooling medium may be utilized to cool various compressor and turbine components.

Buckets are one example of a hot gas path component that must be cooled. For example, various parts of the bucket, such as the airfoil, the platform, the shank, and the dovetail, require cooling. Thus, various cooling passages and cooling circuits may be defined in the various parts of the bucket, and cooling medium may be flowed through the various cooling passages and cooling circuits to cool the bucket.

Specifically, various strategies are known for cooling the platform. For example, a cooling circuit may be provided in the platform, and cooling medium may be supplied directly to this cooling circuit to cool the platform. However, various difficulties may be encountered in providing the cooling medium directly to the platform cooling circuit. For example, in many cases, the cooling medium provided directly to the platform is relatively cooler than would be desired to cool the platform, and thus results in uneven cooling of the platform and high thermal gradients in the platform.

Thus, an improved apparatus and method for treating, such as cooling, a bucket would be desired. Specifically, an improved apparatus and method for providing cooling medium to a platform cooling circuit in a bucket would be advantageous.

BRIEF DESCRIPTION OF THE INVENTION

Aspects and advantages of the invention will be set forth in part in the following description, or may be obvious from the description, or may be learned through practice of the invention.

In one embodiment, a bucket assembly is disclosed. The bucket assembly includes a platform, the platform defining a platform cooling circuit, and an airfoil extending generally radially outward from the platform, the airfoil defining an airfoil cooling circuit. The bucket assembly additionally includes a lower body portion extending generally radially inward from the platform, the lower body portion defining a root and a cooling passage extending from the root, the cooling passage in fluid communication with the airfoil cooling circuit. The bucket assembly further includes a transfer passage defined between and in fluid communication with the airfoil cooling circuit and the platform cooling circuit such that a cooling medium may flow from the airfoil cooling circuit through the transfer passage to the platform cooling circuit.

In another embodiment, a method for treating a bucket assembly is disclosed. The method includes flowing a cooling medium into an airfoil cooling circuit, the airfoil cooling circuit defined in an airfoil that extends generally radially outward from a platform. The method further includes flowing the cooling medium through the airfoil cooling circuit, and exhausting the cooling medium from the airfoil cooling circuit into a platform cooling circuit, the platform cooling circuit defined in the platform.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
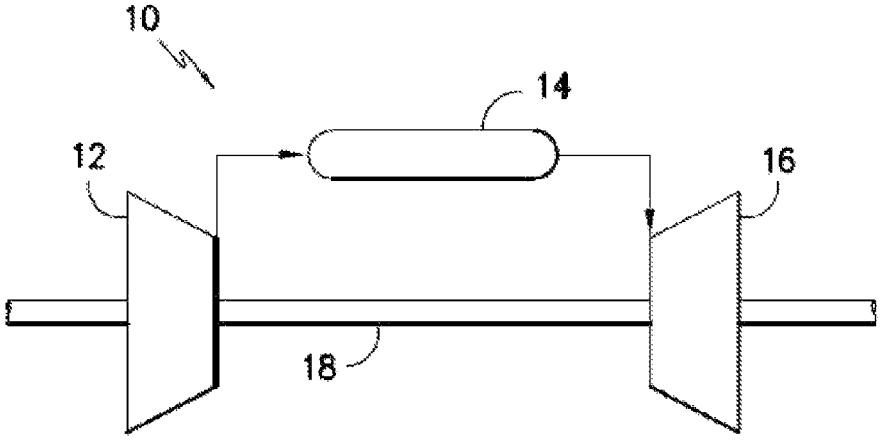
FIG. 1 is a schematic illustration of a gas turbine system according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

Figure 2:
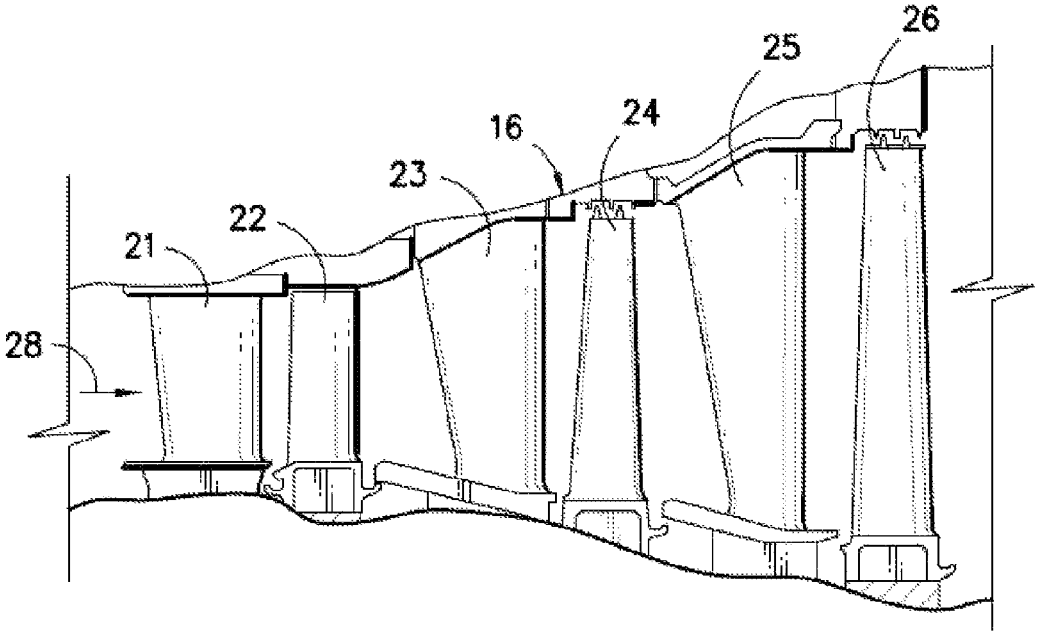
FIG. 2 is a sectional side view of the turbine section of a gas turbine system according to one embodiment of the present disclosure.
Figure 3:
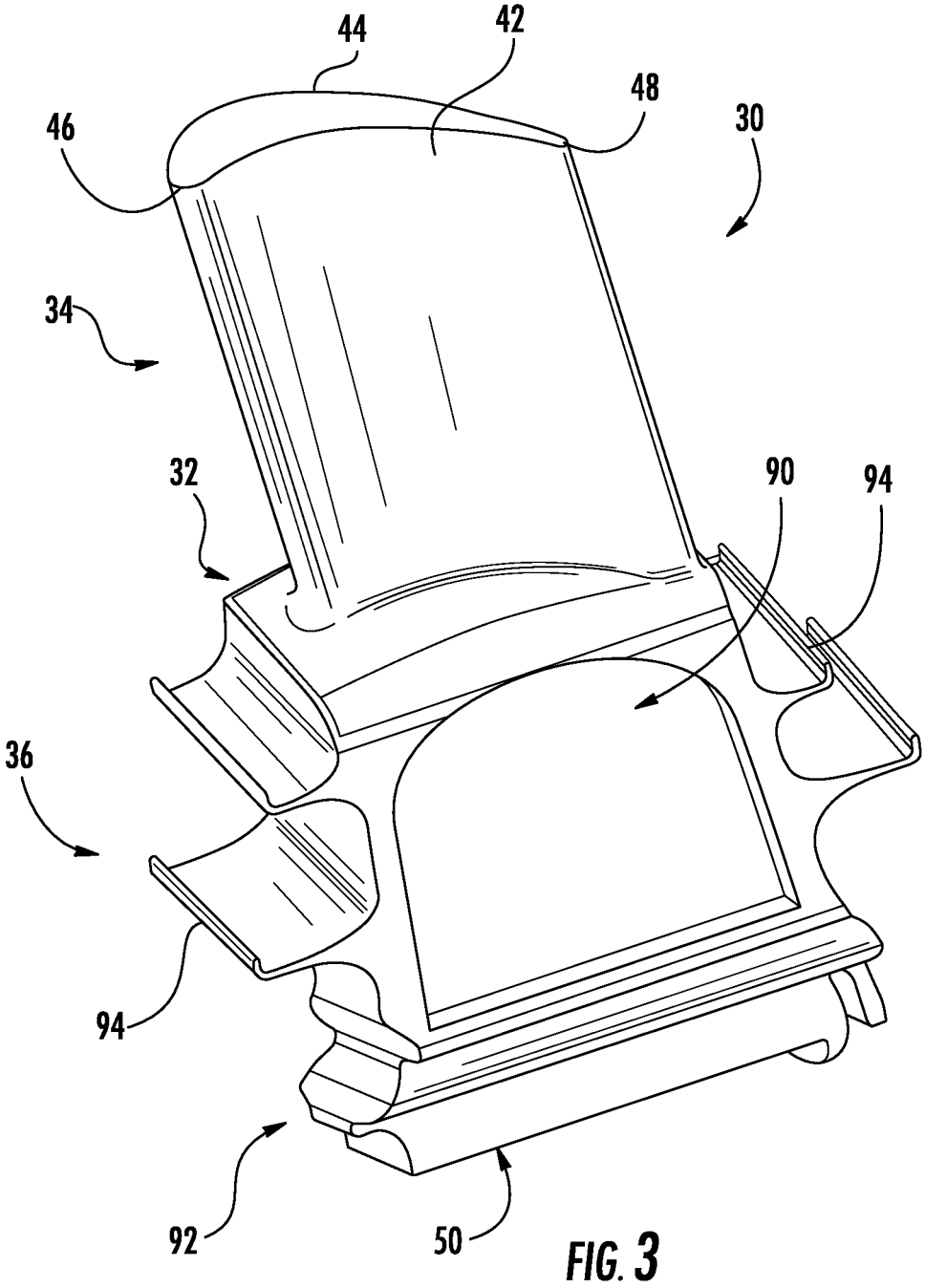
FIG. 3 is a perspective view of a bucket assembly according to one embodiment of the present disclosure.

The turbine 16 may include a plurality of turbine stages. For example, in one embodiment, the turbine 16 may have three stages, as shown in FIG. 2. For example, a first stage of the turbine 16 may include a plurality of circumferentially spaced nozzles 21 and buckets 22. The nozzles 21 may be disposed and fixed circumferentially about the shaft 18. The buckets 22 may be disposed circumferentially about the shaft 18 and coupled to the shaft 18. A second stage of the turbine 16 may include a plurality of circumferentially spaced nozzles 23 and buckets 24. The nozzles 23 may be disposed and fixed circumferentially about the shaft 18. The buckets 24 may be disposed circumferentially about the shaft 18 and coupled to the shaft 18. A third stage of the turbine 16 may include a plurality of circumferentially spaced nozzles 25 and buckets 26. The nozzles 25 may be disposed and fixed circumferentially about the shaft 18. The buckets 26 may be disposed circumferentially about the shaft 18 and coupled to the shaft 18. The various stages of the turbine 16 may be disposed in the turbine 16 in the path of hot gas flow 28. It should be understood that the turbine 16 is not limited to three stages, but rather that any number of stages are within the scope and spirit of the present disclosure.

Additionally, the compressor 12 may include a plurality of compressor stages (not shown). Each of the compressor 12 stages may include a plurality of circumferentially spaced nozzles and buckets.

One or more of the buckets in the turbine 16 and/or the compressor 12 may comprise a bucket assembly 30, as shown in FIGS. 3 through 6. The bucket assembly 30 may include a platform 32, an airfoil 34, and a lower body portion 36. The airfoil 34 may extend generally radially outward from the platform 32, and may generally include a pressure side 42 and a suction side 44 extending between a leading edge 46 and a trailing edge 48.

Figure 4:
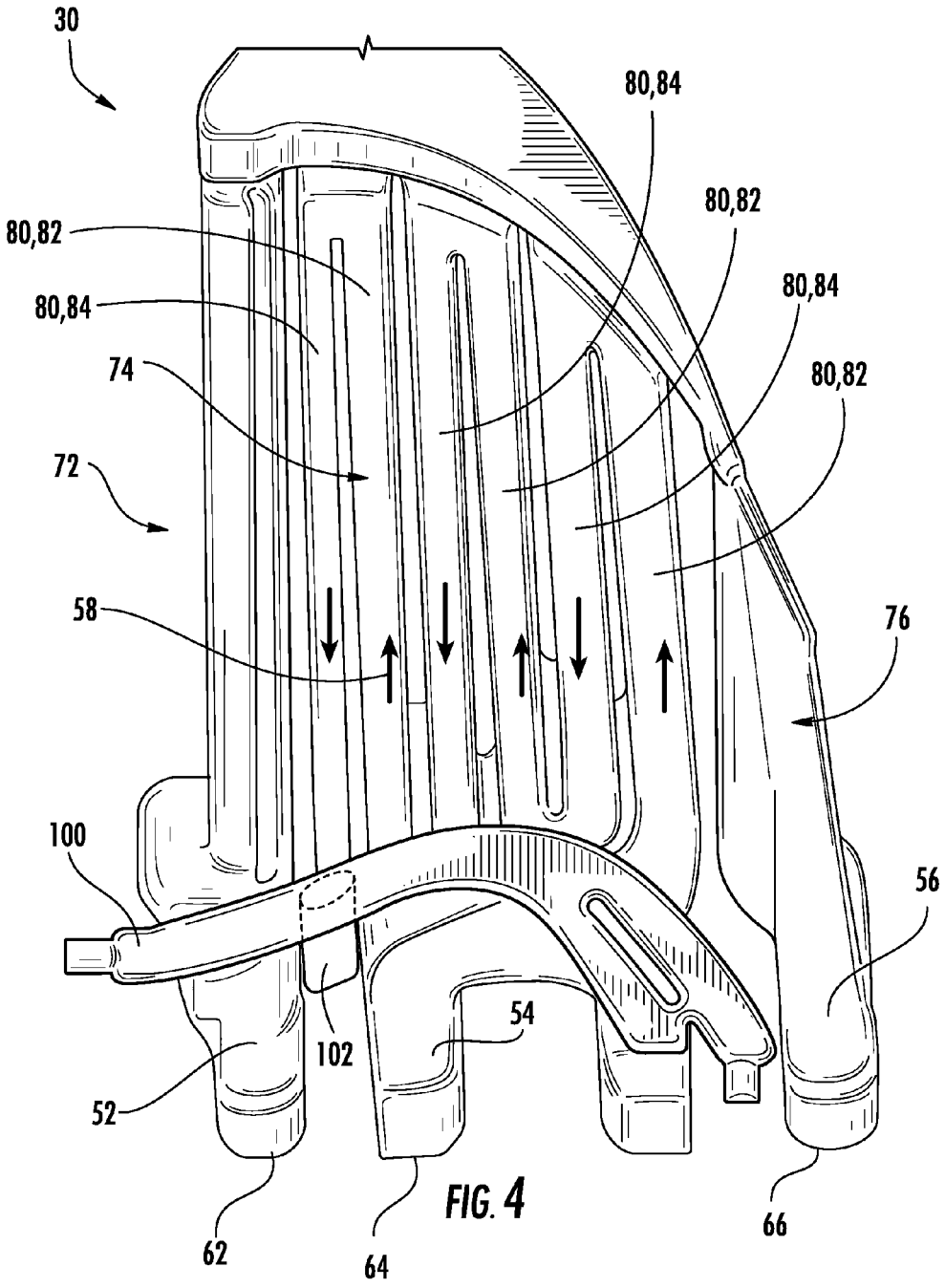
FIG. 4 is a perspective view of various internal components, including various cooling circuits, of a bucket assembly according to one embodiment of the present disclosure.

The lower body portion 36 may extend generally radially inward from the platform 32. The lower body portion 36 may generally define a root 50 of the bucket assembly 30. The root 50 may generally be the base portion of the bucket assembly 30. Further, the lower body portion 36 may define a cooling passage or a plurality of cooling passages extending therethrough. For example, as shown in FIG. 4, the lower body portion 36 may define a leading edge cooling passage 52, a middle cooling passage 54, and a trailing edge cooling passage 56. In exemplary embodiments, the cooling passages 52, 54, 56 may extend from the root 50 through the lower body portion 36. The cooling passages 52, 54, 56 may be configured to flow cooling medium 58 therethrough. For example, openings 62, 64, and 66 of the cooling passages 52, 54, and 56, respectively, may be defined in the lower body portion 36, such as in the root 50. The openings 62, 64, 66 may be provided to accept cooling medium 58, such that the cooling medium 58 may flow through the cooling passages 52, 54, 56.

It should be understood, however, that the present disclosure is not limited to a leading edge cooling passage 52, a middle cooling passage 54, and a trailing edge cooling passage 56. Rather, any number of cooling passages is within the scope and spirit of the present disclosure. For example, one, two, three, four, five or more cooling passages may be defined and have any suitable formation as desired or required.

Figure 5:
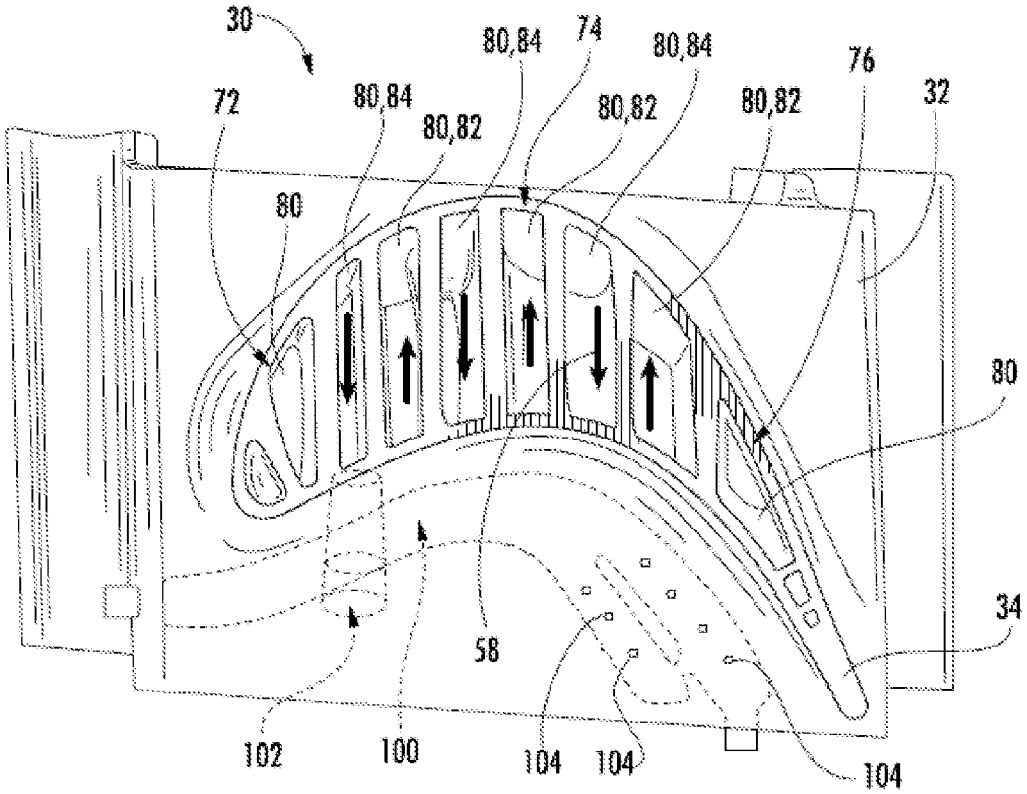
FIG. 5 is a top cross-sectional view of a bucket assembly according to one embodiment of the present disclosure.
Figure 6:
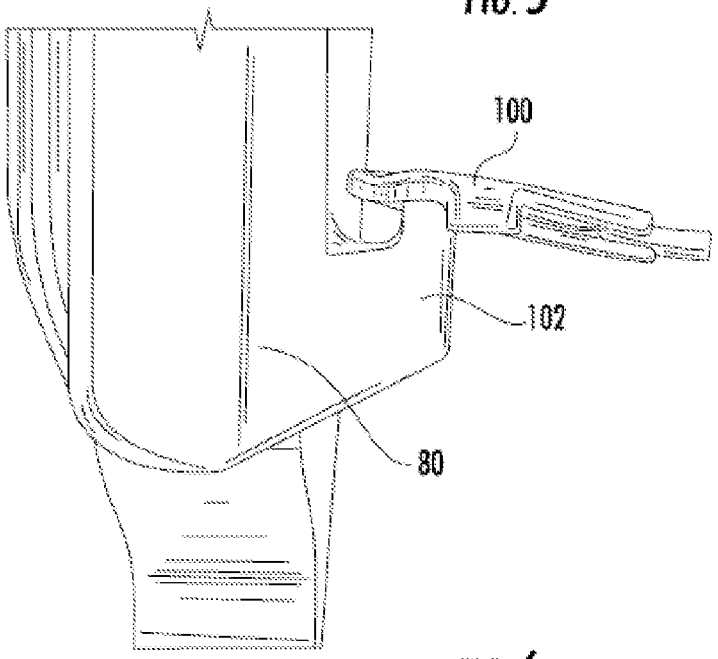
FIG. 6 is a side view of various internal components, including various cooling circuits, of a bucket assembly according to one embodiment of the present disclosure.

A cooling passage according to the present disclosure may be connected to and thus in fluid communication with an airfoil cooling circuit. For example, as shown in FIGS. 4 through 6, leading edge cooling passage 52 may be fluidly connected to leading edge cooling circuit 72, middle cooling passage 54 may be fluidly connected to middle cooling circuit 74, and trailing edge cooling passage 56 may be fluidly connected to trailing edge cooling circuit 76. The airfoil cooling circuits may generally be at least partially or substantially defined in the airfoil 34, and may flow the cooling medium 58 from the cooling passages 52, 54, 56 through the airfoil 34, cooling the airfoil 34.

It should be understood, however, that the present disclosure is not limited to a leading edge cooling circuit 72, a middle cooling circuit 74, and a trailing edge cooling circuit 76. Rather, any number of cooling circuits is within the scope and spirit of the present disclosure. For example, one, two, three, four, five or more cooling circuits may be defined and have any suitable formation as desired or required.

Further, in some embodiments, one or more of the airfoil cooling circuits may include a plurality of passages 80. The passages 80 are branches of the airfoil cooling circuit that are in fluid communication with each other for flowing the cooling medium 58 through the airfoil cooling circuit. Thus, each passage 80 is in fluid communication with at least one other of the plurality of passages 80. In some embodiments, as shown in FIGS. 4 and 5 for example, the passages 80 may be in fluid communication with each other in a generally serpentine pattern. Thus, as shown by the plurality of passages 80 included in the middle cooling circuit 74 of FIGS. 4 and 5, the plurality of passages 80 may include at least one upflow passage 82 and at least one downflow passage 84. An upflow passage 82 may generally flow cooling medium 58 towards the tip and away from the root 50 of the bucket assembly 30, while a downflow passage 84 may generally flow cooling medium 58 away from the tip and towards the root 50 of the bucket assembly 30. The upflow passages 82 and downflow passages 84 may in some embodiments be positioned in a generally alternating fashion. For example, FIGS. 4 and 5 illustrate six passages 80 including three upflow passages 82 alternating and in fluidly communication with three downflow passages 84. However, it should be understood that any number of passages 80, such as two, three, four, five, six, seven, eight or more passages 80, in any suitable formation and pattern are within the scope and spirit of the present disclosure.

Further, FIG. 5 illustrates a leading edge cooling circuit 72 having a plurality of passages 80, a middle cooling circuit 74 having a plurality of passages 80 as discussed above, and a trailing edge cooling circuit 76 having a plurality of passages 80. However, it should be understood that any one or more airfoil cooling circuits having any number of passages 80 is within the scope and spirit of the present disclosure.

The lower body portion 36 may, in exemplary embodiments, include a shank 90 and dovetail 92. The shank 90 may include a plurality of angel wings 94 extending therefrom. The dovetail 92 may define the root 50, and may further be configured to couple the bucket assembly 30 to the shaft 18. For example, the dovetail 92 may secure the bucket assembly 30 to a rotor disk (not shown) disposed on the shaft 18. A plurality of bucket assemblies 30 may thus be disposed circumferentially about the shaft 18 and coupled to the shaft 18, forming a rotor assembly (not shown). It should be understood, however, that the lower body portion 36 is not limited to embodiments including a shank 90 and a dovetail 92. Rather, any configuration of the lower body portion 36 is understood to be within the scope and spirit of the present disclosure.

The platform 32 of the bucket assembly 30 may define at least one platform cooling circuit 100. The platform cooling circuit 100 may generally extend through the platform 32, and may be configured to flow cooling medium 58 therethrough, cooling the platform 32. The platform cooling circuit 100 may extend through the platform 32 having any suitable configuration for cooling the platform 32. For example, the platform cooling circuit 100 may be a generally serpentine cooling circuit and/or may have a variety of branches configured to provide cooling medium 58 to various portions of the platform 32. The platform cooling circuit 100 may further include various portions that extend through the platform 32 adjacent to the pressure side 42, the suction side 44, the leading edge 46, and/or the trailing edge 48 of the airfoil 34, such that those portions of the platform 32 are adequately cooled, as required.

A bucket assembly 30 according to the present disclosure may further include at least one transfer passage 102. The transfer passages 102 may each be defined between and in fluid communication with an airfoil cooling circuit and a platform cooling circuit 100. The transfer passage 102 thus connects the airfoil cooling circuit and the platform cooling circuit 100. The transfer passage 102 thus allows cooling medium 58 to be flowed from the airfoil cooling circuit through the transfer passage 102 to the platform cooling circuit 100.

A transfer passage 102 according to the present disclosure may be connected to any suitable airfoil cooling circuit. For example, FIGS. 4 through 6 illustrate a transfer passage 102 defined between and in fluid communication with a downflow passage 84 of a middle cooling circuit 74 and a platform cooling circuit 100. Additionally or alternatively, a transfer passage 102 may be connected to an upflow passage 82 or any suitable passage 80 of a leading edge cooling circuit 72, middle cooling circuit 74, trailing edge cooling circuit 76, or any other suitable airfoil cooling circuit. The transfer passage 102 may thus be defined between and in fluid communication with this airfoil cooling circuit and a platform cooling circuit 100.

In some embodiments, as shown in FIG. 5, the platform 32 may further define an exhaust passage 104 or a plurality of exhaust passages 104. The exhaust passages 104 may, for example, extend from the platform cooling circuit 100 through the platform 32 to the exterior of the platform 32, or to any other suitable exhaust location. The exhaust passages 104 may thus be configured to exhaust cooling medium 58 from the platform cooling circuit 100 adjacent to the platform 32. For example, at least a portion of the cooling medium 58 flowing through the platform cooling circuit 100 may flow into and through the exhaust passages 104, thus being exhausted from the platform cooling circuit 100.

The transfer passages 102 as disclosed herein may advantageously provide for improved cooling of a bucket assembly 30, and specifically improved cooling of a platform 32. For example, as discussed above, the transfer passages 102 flow cooling medium 58 from an airfoil cooling circuit to a platform cooling circuit 100. Because the cooling medium 58 provided to the transfer passages 102 has already flowed through at least a portion of an airfoil cooling circuit, the cooling medium 58 may be relatively hotter than cooling medium supplied directly to a platform cooling circuit 100 or from a cooling passage to a cooling circuit 100. Cooling of the platform 32 with this relatively hotter cooling medium advantageously results in more even cooling of the platform 32 and lower thermal gradients in the platform 32.

The present disclosure is further directed to a method for treating a bucket assembly 30. The method may include, for example, flowing a cooling medium 58 into an airfoil cooling circuit and flowing the cooling medium 58 through the airfoil cooling circuit, as discussed above. The method may further include exhausting the cooling medium 58 from the airfoil cooling circuit into a platform cooling circuit 100. For example, exhausting of the cooling medium 58 from the airfoil cooling circuit into a platform cooling circuit 100 may occur in exemplary embodiments through a transfer passage 102, as discussed above.

The method may further include, for example, flowing the cooling medium 58 through the platform cooling circuit 100 and exhausting the cooling medium 58 from the platform cooling circuit 100, as discussed above.

It should be noted that while cooling medium 58 flowed into a bucket assembly 30 may be flowed into and through an airfoil cooling circuit and a platform cooling circuit 100 as discussed above, in various embodiments portions of that cooling medium 58 may be flowed through other features of the bucket assembly 30 in order to treat, such as cool, the bucket assembly. For example, portions of the cooling medium 58 flowing through a leading edge cooling circuit 72 may be flowed through film cooling holes defined in or adjacent to the leading edge 46 to provide film treating to the bucket assembly 30. Portions of the cooling medium 58 flowing through a middle cooling circuit 74 may be flowed through film cooling holes defined in or adjacent to the tip to provide film treating to the bucket assembly 30. Portions of the cooling medium 58 flowing through a trailing edge cooling circuit 76 may be exhausted through cooling holes defined in or adjacent to the trailing edge 48. As disclosed above, portions of the cooling medium 58 flowed into a bucket assembly 30 may be flowed into and through an airfoil cooling circuit and a platform cooling circuit 100 in accordance with the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bucket assembly comprising:

a platform, the platform defining a platform cooling circuit;

an airfoil extending generally radially outward from the platform, the airfoil defining an airfoil cooling circuit;

a lower body portion extending generally radially inward from the platform, the lower body portion defining a root and a cooling passage extending from the root, the cooling passage in fluid communication with the airfoil cooling circuit; and a transfer passage defined between and in fluid communication with the airfoil cooling circuit and the platform cooling circuit such that a cooling medium may flow from the airfoil cooling circuit through the transfer passage to the platform cooling circuit, wherein the airfoil cooling circuit terminates at the transfer passage such that cooling medium flowing from a terminal end of the airfoil cooling circuit flows only into the transfer passage, and wherein the transfer passage couples to the platform cooling circuit between an upstream end of the platform cooling circuit and a downstream end of the platform cooling circuit at a location spaced apart from the upstream end of the platform cooling circuit and the downstream end of the platform cooling circuit.

2. The bucket assembly of claim 1, further comprising a plurality of transfer passages.

3. The bucket assembly of claim 1, wherein the airfoil defines a plurality of airfoil cooling circuits and the lower body portion defines a plurality of cooling passages, each of the cooling passages in fluid communication with one of the airfoil cooling circuits, and wherein the transfer passage is defined between and in fluid communication with one of the plurality of airfoil cooling circuits and the platform cooling circuit.

4. The bucket assembly of claim 3, wherein the plurality of airfoil cooling circuits comprises a leading edge cooling circuit, a middle cooling circuit, and a trailing edge cooling circuit, and wherein the transfer passage is defined between and in fluid communication with the middle cooling circuit and the platform cooling circuit.

5. The bucket assembly of claim 3, wherein at least one of the plurality of airfoil cooling circuits comprises a plurality of passages, each of the plurality of passages in fluid communication with another of the plurality of passages, and wherein the transfer passage is defined between and in fluid communication with one of the plurality of passages and the platform cooling circuit.

6. The bucket assembly of claim 5, wherein the plurality of passages includes at least one upflow passage and at least one downflow passage, and wherein the transfer passage is defined between and in fluid communication with the at least one downflow passage and the platform cooling circuit.

7. The bucket assembly of claim 1, the platform further defining an exhaust passage, the exhaust passage configured to exhaust cooling medium from the platform cooling circuit adjacent the platform.

8. The bucket assembly of claim 1, wherein the lower body portion includes a shank and a dovetail, the dovetail defining the root.

9. A turbine system comprising:

a compressor;

a turbine coupled to the compressor;

a plurality of bucket assemblies disposed in at least one of the compressor or the turbine, at least one of the bucket assemblies comprising:

a platform, the platform defining a platform cooling circuit;

an airfoil extending generally radially outward from the platform, the airfoil defining an airfoil cooling circuit;

a lower body portion extending generally radially inward from the platform, the lower body portion defining a root and a cooling passage extending from the root, the cooling passage in fluid communication with the airfoil cooling circuit; and a transfer passage defined between and in fluid communication with the airfoil cooling circuit and the platform cooling circuit such that a cooling medium may flow from the airfoil cooling circuit through the transfer passage to the platform cooling circuit, wherein the airfoil cooling circuit terminates at the transfer passage such that cooling medium flowing from a terminal end of the airfoil cooling circuit flows only into the transfer passage, and wherein the transfer passage couples to the platform cooling circuit between an upstream end of the platform cooling circuit and a downstream end of the platform cooling circuit at a location spaced apart from the upstream end of the platform cooling circuit and the downstream end of the platform cooling circuit.

10. The turbine system of claim 9, further comprising a plurality of transfer passages.

11. The turbine system of claim 9, wherein the airfoil defines a plurality of airfoil cooling circuits and the lower body portion defines a plurality of cooling passages, each of the cooling passages in fluid communication with one of the airfoil cooling circuits, and wherein the transfer passage is defined between and in fluid communication with one of the plurality of airfoil cooling circuits and the platform cooling circuit.

12. The turbine system of claim 11, wherein the plurality of airfoil cooling circuits comprises a leading edge cooling circuit, a middle cooling circuit, and a trailing edge cooling circuit, and wherein the transfer passage is defined between and in fluid communication with the middle cooling circuit and the platform cooling circuit.

13. The turbine system of claim 11, wherein at least one of the plurality of airfoil cooling circuits comprises a plurality of passages, each of the plurality of passages in fluid communication with another of the plurality of passages, and wherein the transfer passage is defined between and in fluid communication with one of the plurality of passages and the platform cooling circuit.

14. The turbine system of claim 13, wherein the plurality of passages includes at least one upflow passage and at least one downflow passage, and wherein the transfer passage is defined between and in fluid communication with the at least one downflow passage and the platform cooling circuit.

15. The turbine system of claim 9, the platform further defining an exhaust passage, the exhaust passage configured to exhaust cooling medium from the platform cooling circuit adjacent the platform.

16. The turbine system of claim 9, wherein the lower body portion includes a shank and a dovetail, the dovetail defining the root.

17. The turbine system of claim 9, wherein each of the plurality of bucket assemblies comprises a platform, an airfoil, a lower body portion, and a transfer passage.

18. The turbine system of claim 9, wherein the plurality of bucket assemblies are disposed in the turbine.

19. A method for treating a bucket assembly, the method comprising:

flowing a cooling medium into an airfoil cooling circuit from a cooling passage, the airfoil cooling circuit defined in an airfoil that extends generally radially outward from a platform, the cooling passage defined in a root that extends generally radially inward from the platform;

flowing the cooling medium through the airfoil cooling circuit; and, exhausting the cooling medium from the airfoil cooling circuit into a platform cooling circuit through a transfer passage, the platform cooling circuit defined in the platform, wherein the airfoil cooling circuit terminates at the transfer passage such that cooling medium flowing from a terminal end of the airfoil cooling circuit flows only into the transfer passage, and wherein the transfer passage couples to the platform cooling circuit between an upstream end of the platform cooling circuit and a downstream end of the platform cooling circuit at a location spaced apart from the upstream end of the platform cooling circuit and the downstream end of the platform cooling circuit.

20. The method of claim 19, further comprising flowing the cooling medium through the platform cooling circuit and exhausting the cooling medium from the platform cooling circuit.

* * * * *